US006929341B2

(12) United States Patent
Mizoguchi et al.

(10) Patent No.: US 6,929,341 B2
(45) Date of Patent: Aug. 16, 2005

(54) INK JET RECORDING APPARATUS, INK CONTAINER, AND INK CARTRIDGE

(75) Inventors: Yoshito Mizoguchi, Kanagawa (JP); Toshimitsu Danzuka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 10/632,900

(22) Filed: Aug. 4, 2003

(65) Prior Publication Data

US 2004/0021713 A1 Feb. 5, 2004

(30) Foreign Application Priority Data

Aug. 5, 2002 (JP) ..... 2002-227845

(51) Int. Cl.[7] ..... B41J 2/195
(52) U.S. Cl. ..... 347/7
(58) Field of Search ..... 347/5–7, 21, 66–67, 347/84–85, 95, 100, 87

(56) References Cited

U.S. PATENT DOCUMENTS 4,926,196 A 5/1990 Mizoguchi et al. ..... 347/23
6,786,588 B2 * 9/2004 Koyano et al. ..... 347/100
2002/0063759 A1 5/2002 Hirano et al. ..... 347/85

FOREIGN PATENT DOCUMENTS

JP 2000-334982 12/2000

* cited by examiner

*Primary Examiner*—Hai Pham
(74) *Attorney, Agent, or Firm*—Fitzpatrick, Cella, Harper & Scinto

(57) ABSTRACT

In the ink jet recording apparatus using an on-demand supply system, an image natural and stable in color tone is output. For this purpose, when a capacity of a sub-tank is represented by A, an amount of residual ink remaining after the ink has been discharged is represented by "a", a ratio by weight of a volatile component in a composition of ink used is represented by B and a ratio of a colorant concentration of ink at saturated state made by repeating ink supply and ink discharge, to an initial colorant concentration of the ink is represented by R, they are satisfying an equation of $A/(A-a\times B)=R\leqq 1.20$.

7 Claims, 8 Drawing Sheets

WHEN THE RECORDING OPERATION HAS FINISHED

AFTER INK HAS BEEN DISCHARGED

AFTER INK HAS BEEN VAPORIZED

WHEN INK HAS BEEN FILLED NEXT TIME

INK JET RECORDING APPARATUS, INK CONTAINER, AND INK CARTRIDGE

This application claims priority from Japanese Patent Application No. 2002-227845 filed Aug. 5, 2002, which is incorporated hereinto by reference.

BACKGROUND OF THE INVENTION

1. Field of the Invention

The present invention relates to an ink jet recording apparatus, specifically to an ink supply recovery for supplying ink from a main-tank to a small sub-tank for directly supplying ink to a recording head at a predetermined timing.

2. Description of the Related Art

There is an ink jet recording apparatus of a serial scanning system for realizing a smaller sized apparatus. The ink jet recording apparatus of a serial scanning system is provided with a carriage movable in a main scanning direction. Further, an ink jet recording head as recording means and an ink tank as an ink container are mounted in a replaceable manner to the carriage. An image is recorded on a recording medium by the repetition of the main scanning of the carriage and the sub scanning of the recording medium.

Such a recording apparatus may be communicated or integral with PDA (personal digital assistants) or a camera to output the image. In this case, it is desirable to further minimize a size of the carriage or a capacity of the ink tank or ink. However, if the capacity of the ink tank is excessively small, the frequency of the replacement of the ink tank increases, and in an extreme case, it is necessary to replace the ink tank during the recording operation, which is not so practical.

To solve such a problem, the following content has been proposed, for example, in Japanese Patent Application Laid-Open No. 2000-334982. That is, a system is disclosed, including an ink storage member having a relatively small capacity provided in the carriage (hereinafter referred to as a sub-tank) and an ink storage member having a relatively large capacity provided at a fixed position of the apparatus (hereinafter referred to as a main-tank), in which ink is replenished from the main-tank to the sub-tank at a suitable timing (which system is referred to as "an on-demand supply system". According to the on-demand supply system, it is possible to use the main-tank having a far larger ink capacity than the sub-tank on the carriage. Thereby, the replacement of the ink tank does not occur so frequently. Also, even if the ink capacity of the sub-tank is small, it is possible to replenish ink to the sub-tank at a suitable timing. Accordingly, the problem in that no ink exists in the sub-tank during the recording operation could be solved.

However, in the prior art on-demand supply system, there is a problem described below when the ink jet recording apparatus has been left unused for a long period. That is, a volatile component in the ink stored in the sub-tank is vaporized to increase the concentration of ink colorant. If the concentration of the ink colorant increases, a color tone of an image to be initially recorded next time becomes unnatural, which differentiates the color tone between a plurality of sequentially recorded images. Such a phenomenon is more significant as the environment in which the recording apparatus is left is lower in humidity. This problem is particularly unfavorable in a recording apparatus for a camera for recording a photograph.

Several countermeasures have already been proposed to solve the above-mentioned problem. For example, it is considered as one of countermeasures to provide a mechanism for closing an opening of the sub-tank if necessary. Another is considered, which is to use a material having a low gas-permeability for the sub-tank. Further, another method is considered in which a thickness of the tank may be increased. In either of the countermeasures, it is possible to reduce the evaporation to a certain extent. However, these countermeasures are not essential but may be a so-called symptomatic treatment expecting the prolongation of life unless the evaporation becomes zero. Also, these countermeasures result in the cost-up and the enlargement of the size of the sub-tank as well as disturb the miniaturization of the recording apparatus. Thus, these countermeasures have not completely been effective.

Also as the other countermeasure, ink may be once withdrawn from the sub-tank after the recording operation has finished. According to this method, the next recording operation can be carried out at a stable concentration of colorant of the ink stored in the main-tank, irrespective of the colorant concentration of the ink left in the sub-tank. However, the present inventors have confirmed that a desired effect may not obtained in some cases when the relationship is uncertain among a size of the sub-tank, an amount of residual ink and the composition of ink used. The method of discharging ink from the sub-tank after recording operation is not known to the public. Also, the following problems which occur when this method is employed, of course, are not known to the public too.

Problems inherent to the above method will be described below with reference to the attached drawings.

FIGS. 1A to 1D are an illustration for explaining the relationship between the sub-tank and ink in the sub-tank in the on-demand supply system.

FIG. 1A represents the sub-tank when the recording operation has finished. An ink absorber B401 is filled in the sub-tank B400 for generating a negative pressure for sucking ink therein. In this example, a sponge is used for the ink absorber B401.

In FIG. 1A, a medium amount of ink is left in the ink absorber B401.

FIG. 2B represents the sub-tank B400 immediately after the ink has been withdrawn there from a state shown in FIG. 1A. While the ink is withdrawn, the ink once absorbed in the ink absorber B401 is not completely removable. Ink such as one adhered to sponge fibers is left as it is.

FIG. 1C represents a state of the sub-tank left for a little while in the state shown in FIG. 1B. In this state, a volatile component of the ink left in the sub-tank B400 is vaporized to some extent. Therefore, an amount of ink is less than that in the state shown in FIG. 1B. However, only the volatile component is vaporized, the concentration of the colorant in the ink becomes rather higher.

FIG. 1D represents a state of the sub-tank again filled with ink for the next recording operation. In this state, ink of normal concentration is filled in the sub-tank shown in FIG. 1C in which the ink with high colorant concentration is left. Accordingly, the colorant concentration of ink becomes somewhat higher than in the initial state.

To understand such a state in more detail, the present inventors have made a sub-tank of a conventional on-demand supply system and studied the relationship the colorant concentration and the image by using this sub-tank. The content and result of this study performed by the present inventors will be described below.

First, polypropylene fibers having a bulk volume of 0.01 cc was filled as a sponge in the sub-tank having the capacity of 0.1 cc. As described with reference to FIGS. 1A to 1D, the operation was repeated for "removing the residual ink from the sub-tank after the recording operation, and after the sub-tank is dried, filling fresh ink again therein and a recording an image". As a result, after such an operation was repeated a plurality of times, an image of an unnatural color tone was obtained because the colorant concentration of ink is too high. Further, when the same images were sequentially recorded, it has been confirmed that the difference in color tone becomes significant between the plurality of images.

The present inventors have strictly measured an amount of ink in the sub-tank in each of processes in the repetition of the operation. It is ideal that an amount of ink obtained by subtracting a volume of the sponge from a capacity of the sub-tank; i.e., 0.1−0.01=0.09 (cc) is filled in the sub-tank when the ink is initially filled in the ink. In practice, however, it has been confirmed that the amount of ink is of the order of 0.08 cc. This is because air initially existing in the sponge is left in the ink as micro-bubbles (dead air). It has been confirmed that a volume of the dead air is approximately 0.01 cc. Accordingly, the amount of ink which could be filled in the sub-tank has been 0.1 (the capacity of the sub-tank)−0.01 (the bulk volume of sponge)−0.01 (the amount of dead air)=0.08 (cc).

In the state shown in FIG. 1B in which the ink has been sucked out from the sub-tank, it has been confirmed that an amount of residual ink which was not discharged or adhered to the sponge is approximately 0.02 cc. This amount of ink does not disturb the formation of image in the usual ink jet recording apparatus having the ink tank of several cc to several tens cc. However, when the apparatus is of the on-demand supply system using the sub-tank of 0.1 cc, this value cannot be neglected.

In this regard, when the composition of ink used in the above-mentioned study is represented by a weight ratio, a volatile component (which can be vaporized) such as water or isopropyl alcohol is 0.7, a component difficult to be volatile such as glycerin is 0.25, and the colorant concentration is 0.05. That is, this ratio is the initial condition of the ink in the sub-tank. As a result of repeating the "recording, withdrawal of ink and filling of ink" thereafter, it was confirmed that the colorant concentration reaches a saturated value of approximately 6.1%. This value is 1.2 times or higher than the initial value of 5%. The "saturated value" referred to in this text represents a value of the colorant concentration in the sub-tank which is never exceeded even if the above operation is repeated. Therefore, this is different from the chemical "saturated value" of the original meaning. In this text, for representing such a state, a term "saturated value" or "saturated state" is conveniently used.

Even if the increase in colorant concentration of ink occurs, the above-mentioned countermeasures are effective provided this value is suppressed beneath a level at which no problem arises in the recorded image. However, when the control of the colorant concentration during the repeated operation is uncertain and the colorant concentration is not within a predetermined range, the rise of the colorant concentration of ink causes the trouble on the recorded image.

SUMMARY OF THE INVENTION

The present invention has been made to solve the above-mentioned problems and an object thereof is to output an image having a natural and stable color tone in the ink jet recording apparatus using an on-demand supply system.

In a first aspect of the present invention, there is provided an ink jet recording apparatus comprising a main-tank for storing ink, a sub-tank for directly supplying ink to a recording head carrying out the printing operation to a recording medium by ejecting ink, ink supply means for supplying a predetermined amount of ink from the main-tank to the sub-tank, and ink discharge means for discharging ink in the sub-tank, wherein assuming that the maximum amount of ink capable of being stored in the sub-tank is represented by A, an amount of residual ink remaining in the sub-tank after the ink has been discharged by the ink discharge means is represented by "a", a ratio by weight of a volatile component in the ink used is represented by B and a ratio of a colorant concentration of the ink at saturated state by repeating the ink supply and the ink discharge, to an initial colorant concentration of the ink is represented by R, the A, the "a" and the B is set so as to satisfy the following equation:

$$A/(A-a\times B)=R\leqq 1.20$$

In a second aspect of the present invention, there is provided an ink storage container for storing a predetermined amount of ink so that the ink is directly supplied to a recording head for carrying out the recording operation on a recording medium by the ejection of ink; the stored ink being discharged therefrom when the recording operation is not carried out; wherein assuming that the maximum amount of ink capable of being stored therein is represented by A, an amount of residual ink remaining therein after the stored ink has been discharged is represented by "a", a ratio by weight of a volatile component in a composition of ink used is represented by B and a ratio of a colorant concentration of ink at saturated state made by repeating ink supply and ink discharge, to an initial colorant concentration of the ink is represented by R, the ink storage container is formed to have the amount "a" of residual ink and the maximum amount A of ink satisfying the following equation:

$$A/(A-a\times B)=R\leqq 1.20$$

In a third aspect of the present invention, there is provided an ink cartridge comprising an ink storage container as claimed in claim 6 and an ink jet head supplied with ink from the container, for carrying out the recording operation by ejecting ink supplied from the container.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The preferred embodiments of the present invention will be described below with reference to the attached drawings.

(1) Basic Construction

An apparatus explained in this embodiment is an information processing equipment having an image taking section (hereinafter referred also to as "a camera section") and an image recording section (hereinafter referred also to as "a recorder section"). The camera section converts an optically taken image to electric signals. The image recording section carries out the recording of the image based on the electric signals obtained from the camera section. The information processing equipment used in this embodiment is hereinafter referred to as "a printer built-in camera" which will be explained below. The following explanation an inkjet recording apparatus integral with a camera section is explained as an example. However, the camera section is not necessary to be built-in the inkjet recording apparatus.

Figure 2:
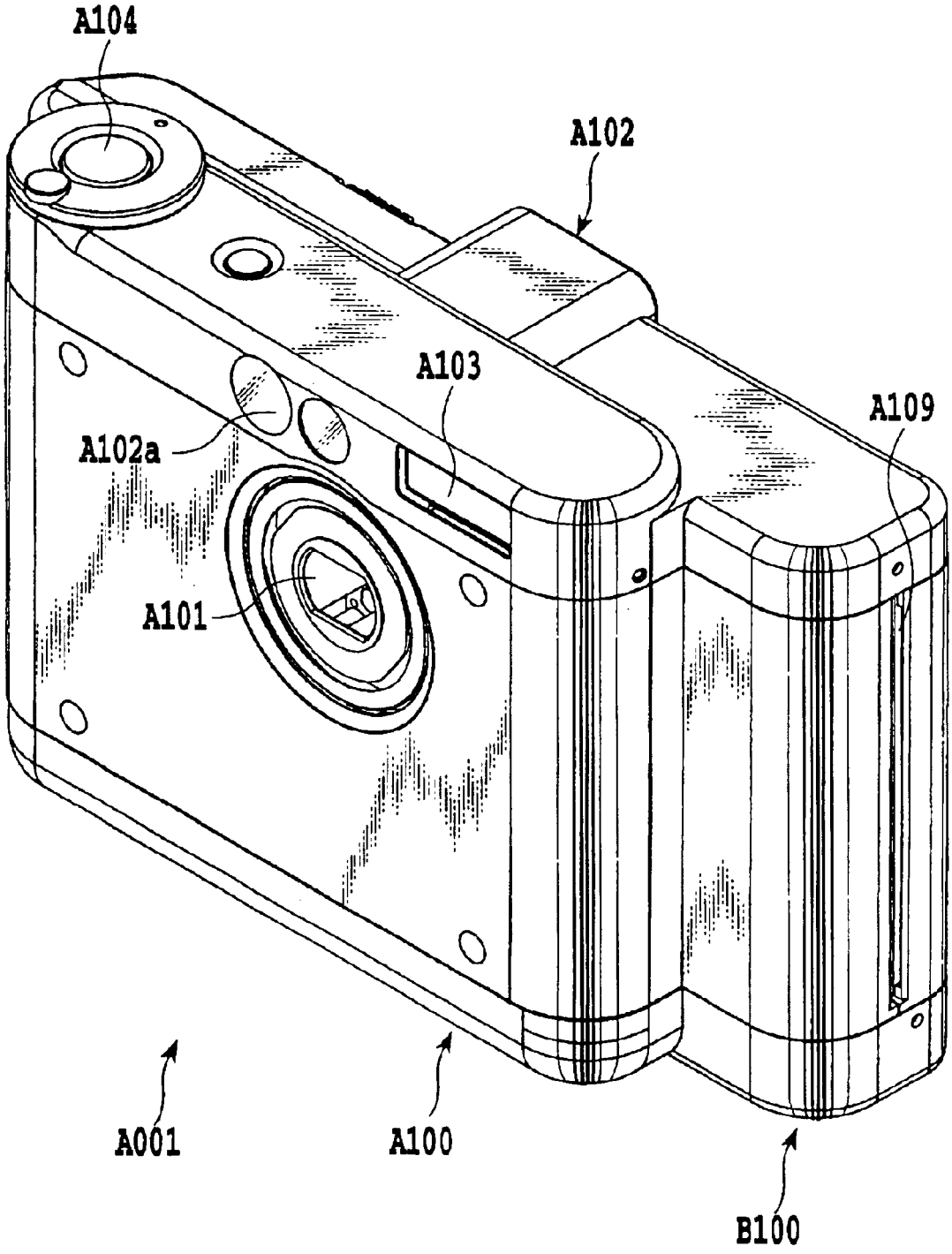
FIG. 2 is a perspective view of a printer built-in type camera to which is applied one embodiment of the present invention.

FIG. 2 is a perspective view of the printer built-in camera used in this embodiment. An apparatus body A001 is formed of a camera section A100 and a recorder section B100 mounted to a back surface of the former. An image taken by the camera section A100 is transferred to the recorder section B100. The recorder section B100 records the image by using ink and recording medium supplied from a media pack described later. The media pack is inserted into a slot not shown located on the left-hand in FIG. 2. The recorded medium is discharged from a paper discharging exit A109. In this regard, a power source for the camera section A100 and the recorder section B100 is a dry battery of size AA accommodated in the body.

(1-1) Camera Section

The camera section A100 is basically a conventional digital camera. In FIG. 2, A101 denotes a lens; A102 denotes a finder; A102 a denotes a finder window; A103 denotes a stroboscope; and A104 denotes a release button. A liquid crystal display section (external display section) is provided on the rear side of the body. The camera section A100 processes image data taken by using CCD, stores the image in a compact flash (a registered trade mark) memory card (CF card), displays the image and transfers various data between the same and the recorder section B100.

(1-2) Media Pack

Figure 3:
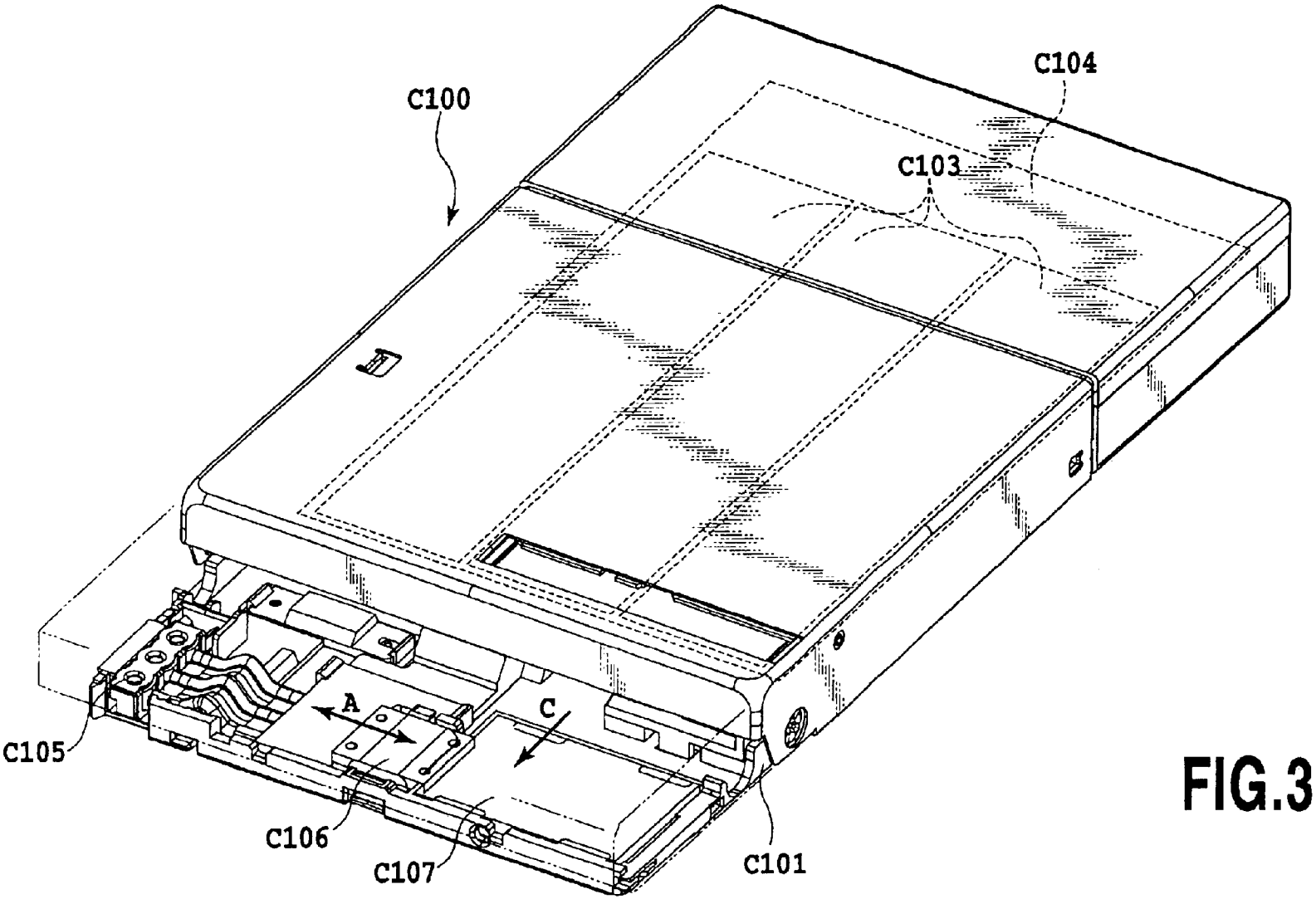
FIG. 3 is a perspective view of a media pack attachable to the camera shown in FIG. 2.

FIG. 3 is a perspective view of a media pack used in this embodiment.

The media pack C100 is mounted to the body A001 through a slot (not shown) located on the left-hand side of the back surface. When the media pack C100 is not mounted, the slot is closed, and when the former is mounted, the slot is open.

In a body C101 of the media pack, three ink packs (ink bags) C103 corresponding to a main-tank are provided. These individually store yellow (Y) ink, magenta (M) ink and cyan (C) ink. Above the ink packs C103, there are a stack of about twenty recording media C104 (in this embodiment, ink jet recording media). The ink packs C103 and the recording media C104 are selected to be an optimum combination for the image recording and stored in the same media pack C100. Plurality kinds of media pack C100 may be prepared by the combination of the ink and the recording medium. For example, the media pack C100 may be selected in accordance with kinds of image or uses of recorded product such as a super-high grade image quality use, a normal image quality use, a seal use or a split seal use and mounted to the apparatus body A001. In this case, if EEPROM (identification IC) is provided in the media pack body C101, it is possible to identify a kind of ink and recording medium or a residual amount thereof.

When the media pack C100 is mounted to the recorder section B100, the ink pack C103 is connected to an ink supply system of the recorder section via three rubber joints C105 corresponding to three kinds of ink Y, M and C, respectively. On the other hand, the recording media C104 are separated one by one by a separating mechanism not shown and delivered by a feed roller in the body in the arrowed direction C.

Also, in the media pack body C101, a wiper C106 for wiping the recording head of the recorder section, and a waste ink absorber C107 for absorbing waste ink discharged from the recorder section are provided.

(1-3) Printer Section

The recording apparatus used in this embodiment is of a serial type using an ink jet recording head, and the explanation thereof will be done separately on "a recording operation section" and "an ink supply recovery system".

(1-3-1) Printing Operation Section

Figure 4:
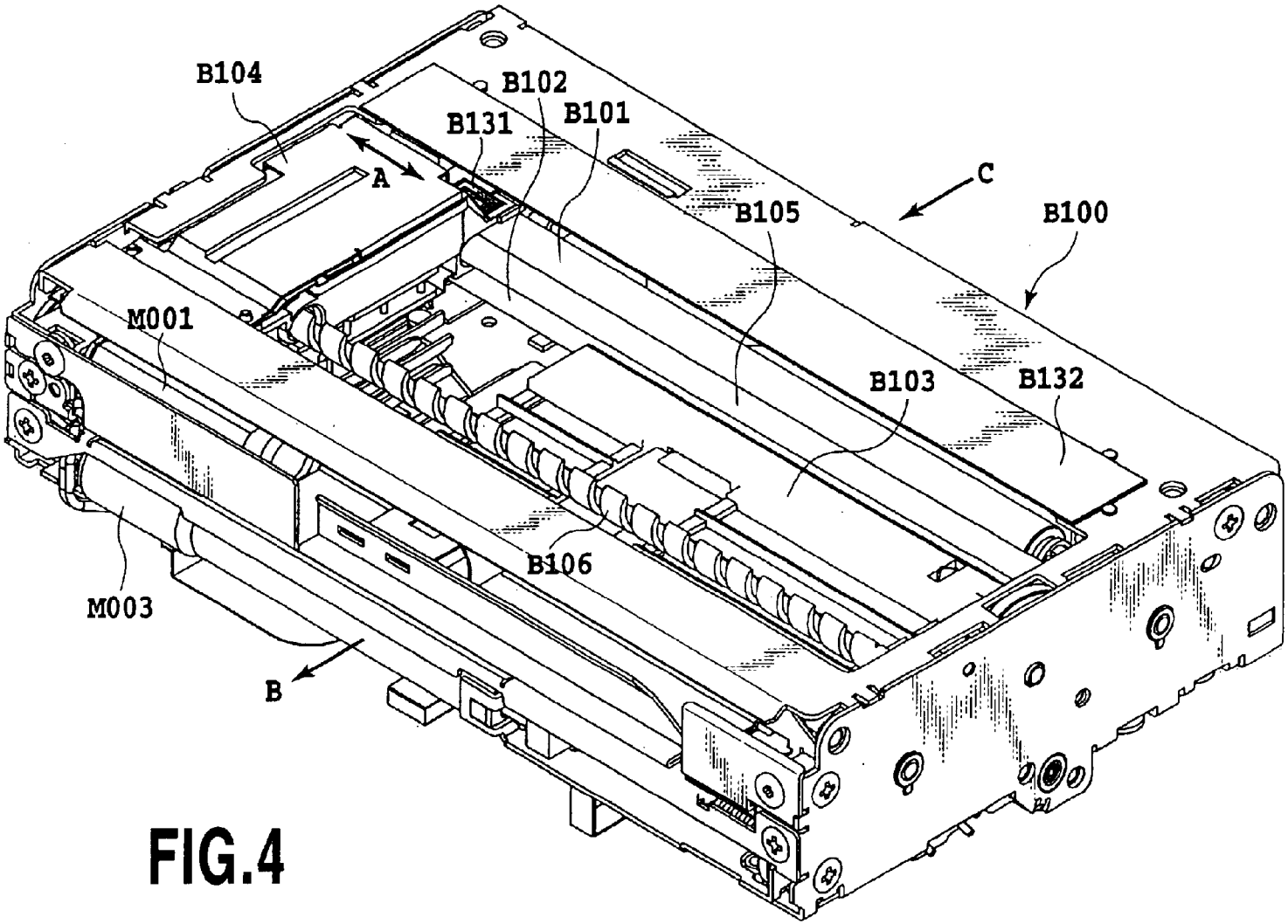
FIG. 4 is a perspective view of a main construction of a recording apparatus applied to the embodiment of the present invention.

FIG. 4 is a perspective view showing the interior structure of the recorder section B100.

The media pack C100 is inserted into the recorder section B100 in the arrowed direction C. The recording medium C104 is delivered from the media pack C100 in the arrowed direction C, and passes over a platen B103 to be conveyed in the arrowed sub scanning direction B while being nipped by an LF roller B101 and an LF pinch roller B102.

B104 denotes a carriage reciprocating in the arrowed main scanning direction A. B106 denotes a lead screw. A projected screw pin is attached by a spring to an inside portion of the carriage B104 baring the lead screw B106. A tip end of the screw pin and a spiral groove provided on the outer periphery of the lead screw B106 are engaged with each other. According to this structure, the rotation of the lead screw B106 is converted to the reciprocation of the carriage B104. The lead screw B106 is driven to rotate by a carriage motor M001 via a screw gear, an idler gear and a motor gear. By the rotation of the lead screw B106 and the support of a guide shaft B105, the reciprocation of the carriage B104 is controlled. Also, a moving position of the carriage B104 is detected by an encoder sensor B131 provided on the carriage B104 and a linear scale sensor B132. When the carriage B104 returns to a home position, a HP sensor detects the carriage B104.

Figure 5:
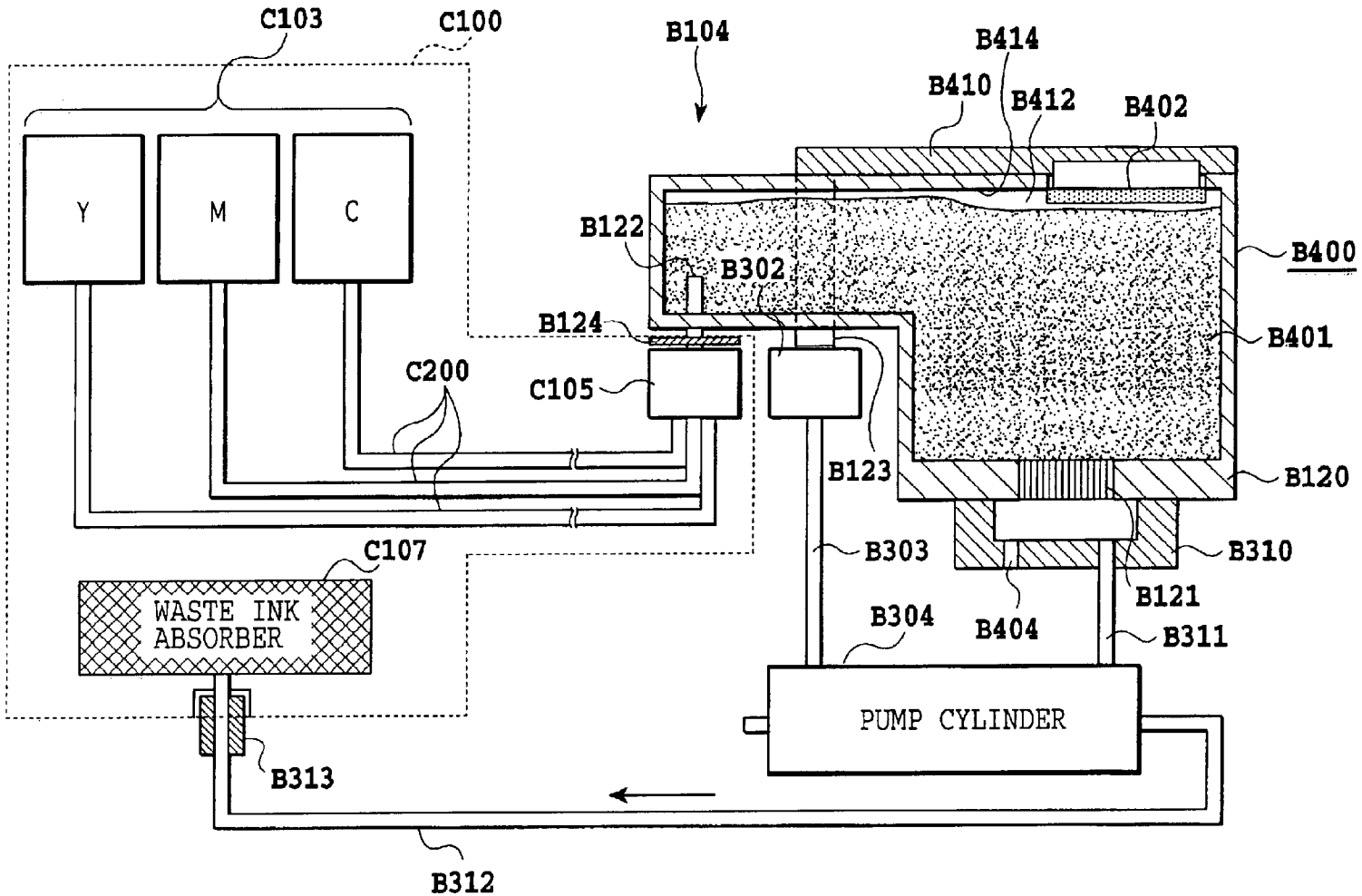
FIG. 5 is a conceptual view of an ink supply recovery system according to the embodiment of the present invention.

FIG. 5 is a conceptual view for explaining the ink supply recovery system. In the drawing, the relationship is illustrated in detail between the carriage B104 and the media pack C100.

Three ink jet recording heads B120 (merely referred to as a recording head) for ejecting ink and three sub-tanks B400 for storing three kinds of ink are mounted to the carriage B104. They are correspondent to three colors of ink Y, M and C, respectively.

A plurality of ink ejection openings B121 are arranged in parallel with the arrowed direction B shown in FIG. 4, in each of the recording heads B120. Ink supplied from the sub-tank B400 is ejected from the respective ink ejection openings B121. An electro-thermal transducer provided in an ink path communicating to the respective ink ejection openings is used as means for generating energy for the ink ejection. The electro-thermal transducer is driven to heat and generates a bubble in the ink within the ink path. Due to this bubbling energy, an ink drop is ejected from the respective ink ejection opening B121 and adheres to the recording medium C104.

A flexible cable coupled to a body substrate is connected to the recording head B120. Via this cable, image signals to be recorded are transferred one line by one line to the recording head B120. The recording head B120 ejects ink in accordance with the image signals while moving in the main scanning direction. The ejected ink reaches the recording medium B103 on the platen B103. After the record scanning of one line has finished, the recording medium is conveyed at a predetermined distance in the sub scanning direction by a recording medium conveying means. By repeating the record scanning of the recording head B120 and the conveyance of the recording medium, the image is formed on the recording medium.

(1-3-2) Ink Supply Recovery System

The ink supply recovery system in this embodiment will be described below.

In FIG. 5, the sub-tanks B400 are provided in correspondence to colors of ink, respectively. The drawing shows a system for one color. The ink storage section of the respective sub-tank B400 is almost filled with the ink absorber (sponge) B401 such as polypropylene fibers, for absorbing and retaining ink. A hollow needle (ink intake section) B122 is provided in the ink storage section. A lateral hole for supplying ink is formed on a side surface of the needle B122 in the vicinity of a tip end thereof and a topmost end thereof is closed.

On the other hand, the three ink packs C103 in the media pack C100 are connected to three rubber joints C105 via the ink supply paths C200, respectively. The rubber joint C105 is located beneath the needle B122 in the sub-tank B400 when the carriage returns to the home position. The rubber joint C105 is coupled to the needle B122 by pushing the rubber joint C105 upward by a joint fork (not shown) provided in the body of the recording apparatus.

B124 denotes a needle cover provided on the carriage side. When the needle B122 is not coupled to the rubber joint C105, the needle cover B124 closes the lateral hole of the needle B122 by a spring force. Thereby, the needle B122 is prevented from being contaminated with dust adhered therewith or mixed therein. When the needle B122 is coupled to the rubber joint C105, the needle cover B124 moves upward in the drawing against the spring force. Thereby, the needle B122 is free from the protection.

A supply joint B302 is provided in the body of the recorder section. The supply joint B302 is connected to a pump cylinder B304 which is means for generating a negative pressure, via a supply tube B303. Also, the body of the recording apparatus is provided with a joint lifter not shown. By the operation of the joint lifter, the supply joint B302 is located on a side of the carriage B104 and connected to an air supply opening B123. The air supply opening B123 can be coupled to the supply joint B302 when the carriage returns to the home position, and connected to one of cylinder chambers of the pump cylinder B304 via the supply joint B302 and the supply tube B303. Thus, a negative pressure introducing path is formed between a negative pressure introducing section of the sub-tank B400 and the pump cylinder B304.

In the negative pressure introducing section provided in the upper portion of the interior of the sub-tank B400, a gas-liquid separating member B402 is provided for allowing air to pass therethrough but inhibiting the passage of ink. Since the gas-liquid separating member B402 allows the passage of air sucked from the sub-tank through the negative pressure introducing path, the interior of the sub-tank is in a negative pressure. Due to this negative pressure, ink is replenished from the media pack C100.

On the other hand, when the ink is sufficiently supplied into the sub-tank and reaches the gas-liquid separating member B402, more ink is inhibited from passing through the gas-liquid separating member B402. Thus, the replenishment of ink is automatically made to stop. Since the gas-liquid separating member B402 is provided in each of the three sub-tanks B400, a replenishing amount of the respective color ink is controlled.

The gas-liquid separating member B402 is subjected to a water/oil repellent treatment. If this treatment is not carried out, the gas-liquid separating film B402 is liable to wet with ink. Particularly, when used for a long period, ink gets into the micro-pores in a portion liable to wet and is retained there. Then, the gas-liquid separating member B402 does not actually results in the gas-liquid separating effect. That is, the air introduction efficiency lowers and the ink supplying ability also lowers. Even if the gas-liquid separating member B402 is subjected to the water/oil repellent treatment, there is a risk in that the gas-liquid separating performance lowers when it has been brought into contact with ink for a long period. To solve this problem, according to this embodiment, a vacant space B412 is provided between the gas-liquid separating member B402 and the ink absorber B401 so that both are not brought into contact with each other unless the ink is replenished. Further, a surface treatment such as a water repellent treatment may be carried out in an inner wall (for example, a surface denoted by B414) of the vacant space B412 to suppress the adhesion of ink thereto.

A suction cap B310 is provided in the body of the recorder section. The suction cap B310 caps the recording head B120 located at the home position. An opening B404 closable relative to the atmosphere by an atmosphere-communication valve and a suction tube B311 pass into the interior of the suction cap B310. Thereby, ink is sucked and discharged from the ink ejection openings B121 of the recording head B120 (suction recovery treatment) by introducing a negative pressure into the interior of the suction cap B310 from the other cylinder chamber of the pump cylinder B304. Also, if necessary, the recording head B120 can discharge useless ink not contributing to the image recording into the suction cap B310 (preliminary discharge treatment). The ink discharged in the suction cap B310 is sucked as waste ink into a waste ink absorber C107 of the media pack C100 from the pump cylinder B304 through a waste liquid tube B312 and a waste liquid joint B313.

The pump cylinder B304 has three ports connected to the supply tube B303, the suction tube B311 and the waste liquid tube B312, and is driven to reciprocate by a pump motor M003. The respective tubes may have valves not shown, respectively, if necessary. When the pump motor M003 is operated, these valves are opened or closed to carry out desired operations. It is adapted that the other suction or discharge operation is not influenced when the valves move upward or downward. Also, a pump HP sensor not shown detects an operating position of the pump. When the recording apparatus is in a standby state, the HP sensor detects that the pump occupies the home position (HP). Thereby, the pump cylinder B304 waits at a position on a HP side of the pump.

When the ink is supplied from the ink pack C103 of the media pack C100 into the sub-tank B400, the joint lifter (or joint fork) is operated by the driving force of the pump motor M003 to couple the rubber joint C105 with the needle B122 and the supply joint B302 with the air suction opening B123, respectively. That is, the ink supply path and the negative pressure introducing path are simultaneously formed in the sub-tank B400. Air in the sub-tank B400 is sucked by the pump cylinder B304 through the negative pressure introducing section B410 and the gas-liquid separating member B402. That is, by applying the negative pressure to the interior of the sub-tank, ink is introduced into the sub-tank B400 from the ink pack C103 as the main-tank. In FIG. 5, the sub-tank B400 is shown in an enlarged scale for the purpose of explanation; it is practically far smaller in capacity than the ink pack C103 stored in the media pack C100. In this regard, the size of the sub-tank is, however, large enough for storing ink necessary for recording the image corresponding to at least one recording medium C104.

After the ink has been supplied to the sub-tank B400, the rubber joint C105 is separated from the needle B122 and the supply joint B302 is separated from the air suction opening B123. Thereafter, the pump cylinder B304 is operated if necessary, to suck the ink in the sub-tank through the suction cap B310. In this embodiment, it is preferable to suck at least an amount of ink existing in the needle B122. Alternatively, on another viewpoint, after sufficient ink has passed through the plurality of ink ejection openings B121 of the recording head B120, the suction is preferably applied to an extent enough for removing bubbles existing in the vicinity of the ink path (or bubbles which may mix with ink).

The wiping function will be briefly described with reference to FIGS. 3 to 5. While the pump motor M003 shown in FIG. 4 is a drive source for moving the joint lifter upward and downward, it may also be a drive source for moving the wiper lifter in the media pack C100 shown in FIG. 3. The wiper C106 moves upward by the operation of the wiper lifter and located to a position at which the wiping of the surface of the recording head B120 is possible. The wiping operation is carried out by moving the recording head B120 or the wiper C106 in the predetermined horizontal direction while maintaining a vertical distance between the wiper C106 and the surface of the recording head B120 in the above-mentioned positional relationship.

The ink supply recovery system using a conventional on-demand supply system has been explained as described above.

The present invention is not limited to a configuration using a media pack C100 which contains ink packs (main-tanks) C103 and recording media C104. Namely, the ink packs (main-tanks) and printing media are not necessarily contained in the same container. For example, similar to a conventional recording apparatus, the present invention may be configured such that printing media can be inserted from outside the apparatus and that the main-tanks themselves each can be mounted on the apparatus independently. In this regard, the sub-tank is preferred to be the enough size capable of containing necessary amount of ink for recording image corresponding to data stored by at least one recording medium.

(2) Ink Supply Recovery in this Embodiment

While the above-mentioned ink supply recovery system is used in this embodiment, a more precise control of the ink supply recovery operation is carried out. The ink supply recovery operation peculiar to the present invention will be described below.

Figure 6:
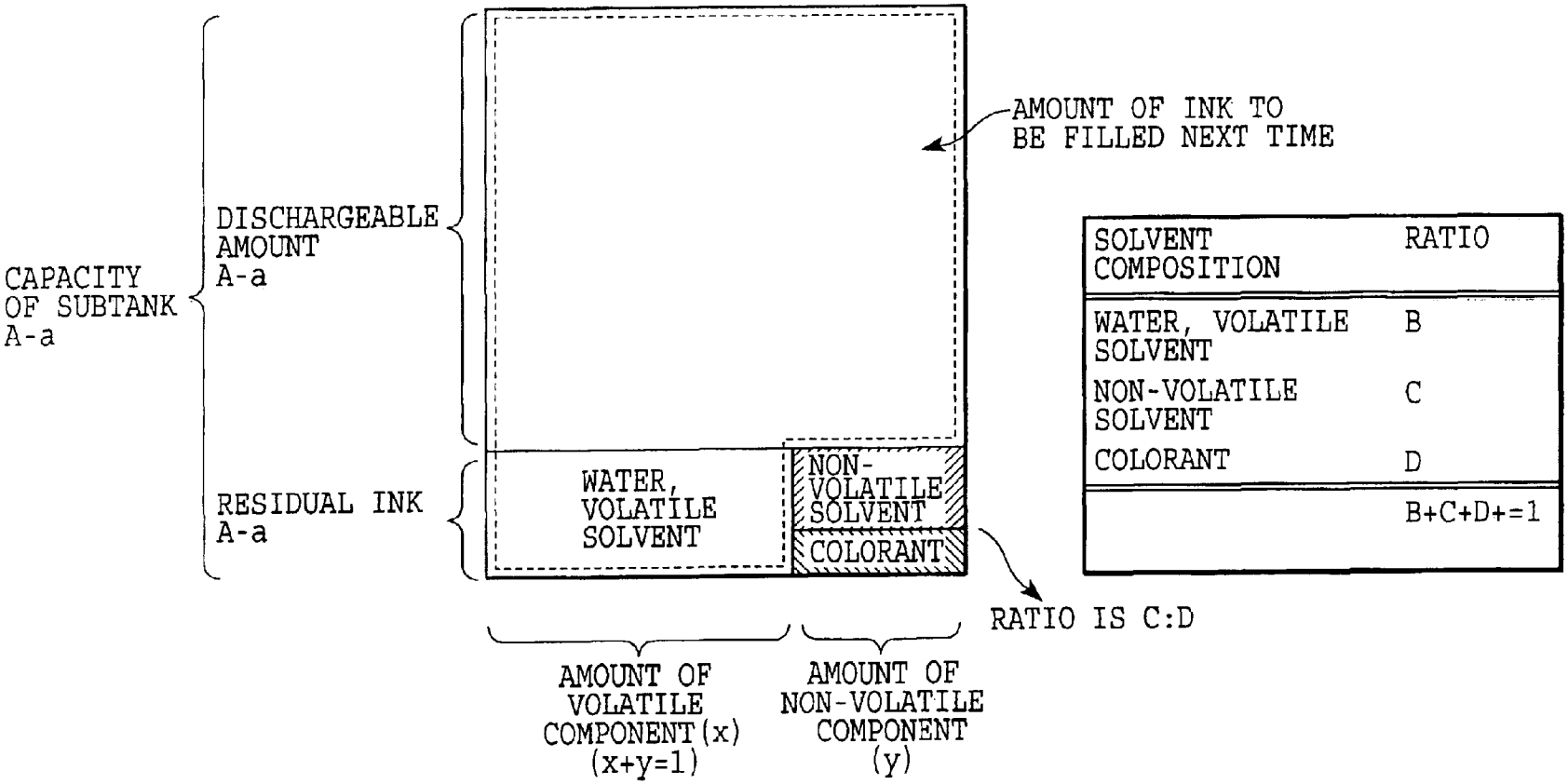
FIG. 6 is a schematic view for explaining a state of ink components in a sub-tank.

FIG. 6 is a schematic illustration for explaining a state of ink components in the sub-tank B400.

Figure 1A:
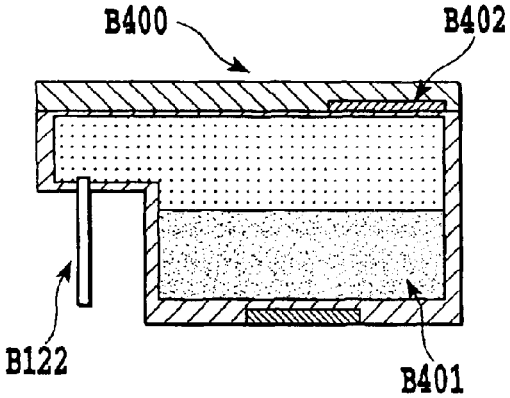
FIGS. 1A to 1D are illustrations for explaining an on-demand supply system in an ink jet recording apparatus.

In FIG. 6, a capacity A of the sub-tank represents a net amount of ink capable of being stored in the sub-tank B400, which is a value obtained by subtracting a bulk volume of sponge or others and a volume of an object disturbing the filling of ink such as dead air from an apparent inner capacity of the sub-tank B400. Accordingly, immediately after the ink has been sucked in the sub-tank, the amount of ink in the sub-tank B400 is the capacity A. Thereafter, when a predetermined amount of ink has been consumed by the recovery prior to the recording and then further consumed by the image recording, a certain amount of ink remains in the sub-tank. It is assumed that this state is represented in FIG. 1A.

Figure 1B:
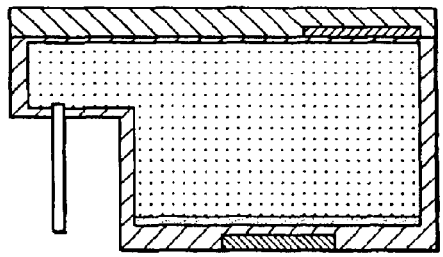
Figure 1C:
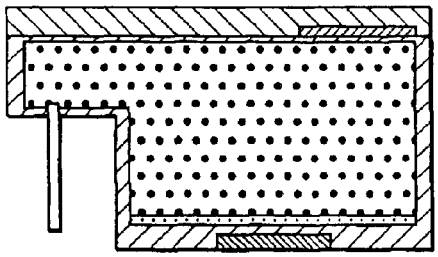
Figure 1D:
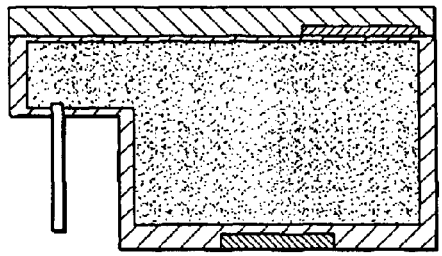

Next, the carriage B104 returns to the home position at which ink in the sub-tank is sucked and discharged (FIG. 1B). As described above, the suction method is in that after the suction cap B310 is brought into tight contact with the recording head B120, the atmosphere-communication opening B404 is closed to introduce the negative pressure from the pump cylinder B304 through the suction tube B311. By the introduction of the negative pressure, ink is discharged from the ink ejection openings B121. Alternatively, in another method for discharging ink, ink may be ejected from the ink ejection openings B121. Also, the combination thereof may be used. In this regard, in view of the durable life of the ink path, after the ink has been discharged by the suction as much as possible, ink existing in the vicinity of the nozzle is preferably discharged by the ejection.

However, after the above-mentioned discharging operation has been carried out, a slight amount of ink remains or soaks into the sponge as shown in FIG. 1B. This amount of residual ink is represented by a in FIG. 6. In this regard, this drawing schematically illustrates the amount of residual ink, and such ink a does not necessarily remain in a lower portion of the sub-tank.

Here, a method for measuring remaining ink amount (a) is explained.

First, a tare weight of recording head (a weight of recording head before an ink is passed through, i.e. a weight immediately after a recording head is manufactured.) is measured beforehand. Thus obtained value is represented by X.

Secondly, the on-demand ink supply, as explained hereinbefore, is carried out with respect to the sub-tank B400. At this juncture, the supplying ink is one color. After the ink has supplied, as described above, the rubber joint C105 is separated from the needle B122, and the supply joint B302 is separated from the air suction opening B123, respectively. Then, the suction cap B310 caps the recording head B120. The atmosphere-communication valve closes the opening B404 communicating with the suction cap B310. The negative pressure is introduced into the interior of the suction cap B310 from the cylinder chamber of a pump cylinder B304 having a connection with the suction tube B311. By thus introduced negative pressure, the ink is suctioned and discharged through ink ejection openings B121 of the recording head B120. In case of a normal recovery operation before printing, the ink suctioning and discharging operation is performed in such manner that the atmosphere-communication valve is opened at a predetermined timing to eliminate the negative pressure within the suction cap B310, thereby stopping the suctioning and discharging of ink. However, in case of measuring the ink remaining amount (a), the atmosphere-communication valve is left closed for a long time in order to have all the ink within the sub-tank to be sucked by the pump.

It is preferred that "a long time" is a time period between the suction operation starts and the ink flow from recording head through the suction tube B311 stops. This phenomenon is recognized, in the observation of the motion of the ink passing through a transparency tube. As the ink within the sub-tank is sucked, air is alternatively drawn into the sub-tank through the needle and/or the gas-liquid separating member. Then upon a completion of ink flow, an interior of the cap is placed under the condition having a communication with the exterior air, and therefore the negative pressure can be gradually eliminated without opening the atmosphere-communication value. In the end, the state in which the flow of the ink and the air stops will be considered to be the state in which all ink has discharged.

Here, the weight of the recording head of this state is measured. The obtained value is represented by Y. X and Y obtained value in this way, is the value "a" of the residual ink. In this regard, it is explained in the case of obtaining the weight value "a" for one color of the C, M, and Y. Another way may be to use. That is, the on-demand supplying and discharging ink is carried out for several color, in which the weight value of residual ink for several color is measured, and is divided by the number of the colors. There is obtained the weight value "a" of the residual ink. In this way, the accuracy is lower than that of obtaining for one color, but more easily. In the above explanation, there appeared an expression of "all ink is suctioned and discharged". However, in the actual measurement, inks such as which is coloring a sponge in the sub-tank or fixing, for example in the corner of the sub-tank, exist. So, it is acknowledged that "all ink cannot be suctioned and discharged". Therefore, such inks are referred to as the remaining ink amount (a).

The ink used in this embodiment is of an aqueous type generally used in the ink jet recording apparatus. The composition of ink is presented by "a" weight ratio among B (usually 70% more or less) of water and volatile component such as alcohol added thereto if necessary, C (usually 25% more or less) of non-volatile solvent such as glycerin and D (usually 5% more or less) of colorant such as dye or pigment. The ink is composed of the above-mentioned three components, in which B+C+D=1.

The volatile component in the residual ink "a" may be vaporized as being left for a long time. Accordingly, the concentration ratio directly after the ink discharge may not be maintained constant. In this text, a weight ratio of volatile component in the residual ink "a" is defined as x and that of non-vaporizing component such as non-volatile solvent or colorant is defined as y. These are defined different from B, C, and D. The weight ratio x of the volatile component is a value different from B. However, a ratio between the solvent and the colorant in the non-vaporizing component y does not change, whereby the relationship between C and D is maintained constant. Of course, x+y=1.

When the volatile component in the residual ink is evaporated, the colorant concentration in the sub-tank gradually increases. The final saturated state is reached when "the colorant concentration in the residual ink "a" becomes equal to "the colorant concentration in the mixed ink in which a portion subtracting the non-volatile component of the residual ink from the capacity A of the sub-tank (a portion encircled by a broken line) is filled with fresh ink having an initial concentration and mixed with the non-volatile component in the residual ink". That is, $$\text{Colorant concentration in the residual ink } a=a\times y\times D/(C+D)/a=y\times D/(C+D) \quad [1]$$

$$\text{Colorant concentration when mixed}=[a\times y\times D/(C+D)+\{(A-a)+a\times x\}\times D/A \quad [2]$$

In the saturated state, [1]=[2]. Further, by using this equation and the equations x+y=1 and B+C+D=1, y=A×(C+D)/(A−a×B) is obtained. If this equation is substituted for [1], the following equation is obtained:

$$[1]=([2]=)A\times D/(A-a\times B)$$

This value is the saturated colorant concentration obtained by repeating the supply and discharge of ink to the sub-tank while the residual ink is evaporating. Accordingly, a ratio between the colorant concentrations of the residual ink condensed to the saturated state and that of initial ink (=D'=[1]=[2]); i.e., the ink condensation percentage R is as follows.

$$R=D'/D=[1]/D=(A-a\times B) \quad [3]$$

The condensation of colorant exceeding this value never occurs due to a mechanism of this system.

As a result, according to this embodiment, the capacity A of the sub-tank and the amount "a" of residual ink are determined so that the condensation percentage R is controlled within an allowable range.

The present inventors has studied to know a limit of the condensation percentage R at which the difference between output images recorded by the initial ink and the ink condensed to be a saturated state is not problematic, and resulted in the following Table 1:

TABLE 1

| Condensation % of ink | Color difference ΔE of output images recorded by the normal ink and the condensed ink, and average appearance. |
|---|---|
| R = 1.15 | ΔE < 5→the difference in tint is not easily recognized. |
| R = 1.20 | ΔE < 10→the difference in tint is recognized but within an allowable range. |
| R = 1.25 | ΔE < 15→the difference in tint is apparently recognized. |

In Table 1, ΔE represents the color difference.

All colors can be numerically represented in the CIE1976 L*a*b* color space defined by International Standards on the L*a*b* coordinates. In this example, when two kinds of ink different in condensation percentage are used while intending to record images in the same color, the colors of the respective images may be represented at different positions on the L*a*b* coordinates. The color difference ΔE indicates a distance between the both. As the value ΔE is larger, the difference in tint is larger to be more easily sensible by human eyes. As shown in Table, since the difference is hardly sensed by the human eyes if ΔE is smaller than 5, it is judged that such a difference is not problematic. However, when ΔE exceeds 10, the difference in tint is sensible if the images recorded thereby are compared as the same ones, which is problematic.

In this regard, the value represented by ΔE=10 as a threshold whether or not the difference is sensible, of course, has an individual difference. Also, the threshold varies according to the position on the coordinates (that is, tint). That is, the threshold may change in accordance with colors or concentrations.

Figure 7A:
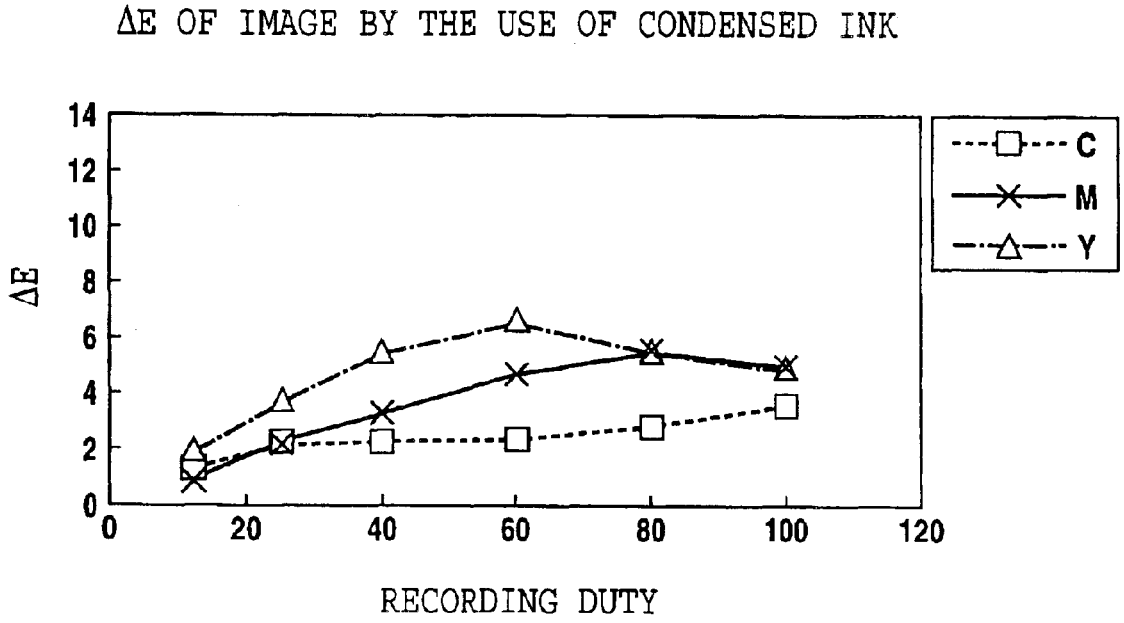
FIGS. 7A and 7B are graphs representing a color difference between images recorded with usual ink and concentrated ink.
Figure 7B:
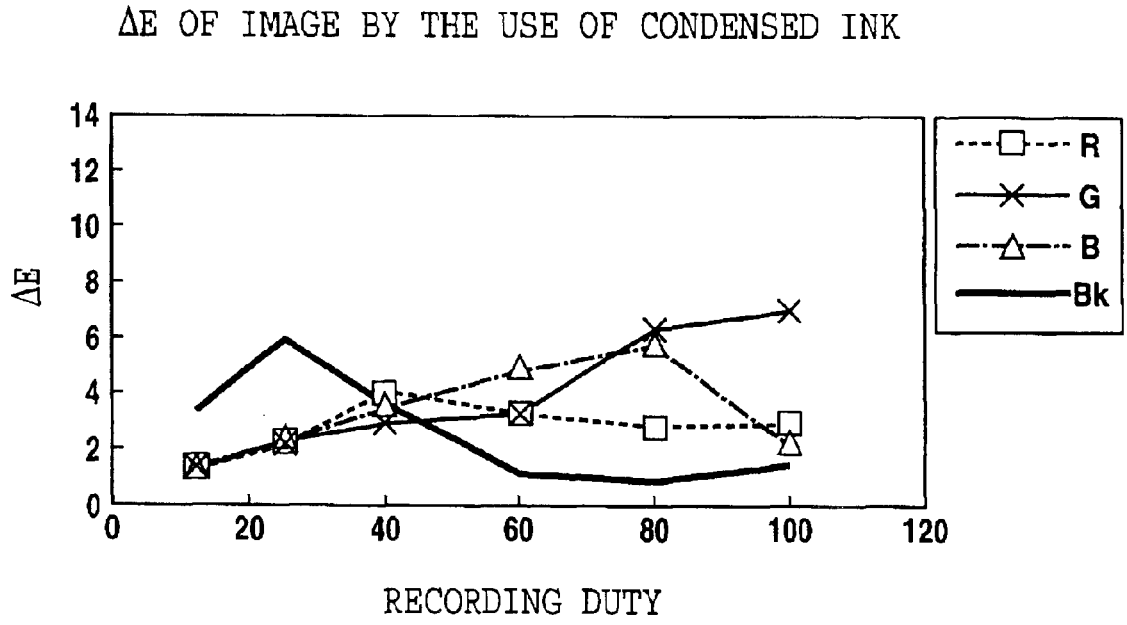

FIGS. 7A and 7B show graphs of the color difference ΔE in the recorded images recorded by using usual ink and the condensed ink having the condensation percentage R of 1.18, respectively, plotted relative to a plurality of colors and recording duties (concentrations). A horizontal axis represents the recording duty and the vertical axis represents the color difference ΔE. FIG. 7A is related to C (cyan), M (magenta) and Y (yellow) which are primary colors. FIG. 7B is related to R (red), G (green) and B (blue) that are secondary colors, as well as Bk (black) which is a tertiary color. According to these two graphs, the values of ΔE are different in accordance with colors of ink even if they are condensed to the same extent. Also, even in the same color, the values ΔE are different in accordance with the recording duty (i.e. concentration). In the case shown in FIGS. 7A and 7B, that is, when the condensation percentage R is 1.18, the maximum color difference ΔE throughout all the colors and recording duties is approximately 7.

The present inventors obtained the maximums ΔE relative to various ink condensation percentages R by the method explained with reference to FIGS. 7A and 7B, results of which are shown in Table 1. Therefore if condensation percentage R is suppressed less than 1.15, the color difference ΔE between the output images could be limited within 5 in almost all colors. Thus, a recording apparatus is provided, capable of outputting images stable in reproduced colors, variation of which is not recognizable by the human eyes.

One method in this embodiment for suppressing the condensation percentage R less than 1.15 will be described below. The recording apparatus used in this embodiment is a small-sized recording apparatus of a camera built-in type capable of outputting a card size recorded medium of approximately 54 mm×86 mm. The recording resolution is 1200×1200 dpi (dot/inch) and an ink droplet is approximately 4 to 5 pl in view of a pixel size. Thus, an amount of ink necessary for recording a card size medium is approximately 0.055 cc. On the other hand, an amount of ink necessary for the recovery after filling is approximately 0.02 cc. Thus, since an amount of ink necessary for the recording and recovery is 0.75 cc, it is determined that a capacity of the sub-tank is 0.1 cc in this embodiment.

The present inventors have confirmed the content described with reference to FIG. 1 in BACKGROUND OF THE INVENTION in this text by using ink in the same manner as in the above discussion. That is, the ratio by weight of ink components is such that a volatile component (evaporative component) such as water or isopropyl alcohol is 0.7, a non-volatile solvent component such as glycerin is 0.25 and a colorant component is 0.05.

The difference of this embodiment from the discussion made in BACKGROUND OF THE INVENTION is that a sponge made of polypropylene having a bulk volume of 0.005 cc is filled in the sub-tank having a capacity of 0.1 cc. This volume is about half a conventional amount. By reducing the degree of compression of sponge approximately in half, it is possible to suppress an amount of residual ink in the fiber of sponge after discharging in half compared with the conventional one. Accordingly, an amount A of ink capable of being stored in the sub-tank is 0.1 cc−0.005 cc (sponge)−0.01 cc (dead air)=0.085 cc. As described above, in the recording apparatus of this embodiment, the amount of ink necessary for the recording and recovery is 0.075 cc. Thus, the residual ink becomes 0.01 cc, from which a ratio R between the colorant concentrations of the residual ink condensed at the saturated state and that of initial ink can be determined. That is, from the equation [3], $$R=A/(A-a\times B)=0.085/(0.085-0.01\times 0.7)=1.09$$

is obtained which satisfies the object of R<1.15.

In this regard, in the above-mentioned recording apparatus, ink in the sub-tank is discharged at a time when the recording of one recording medium has completed. However, this is risky in that the discharging of ink becomes frequent to increase an amount of waste ink. In such a case, a measurement section such as a clock may be provided in the recording apparatus so that the discharging operation is carried out at an instant after a predetermined period has lapsed.

Figure 8:
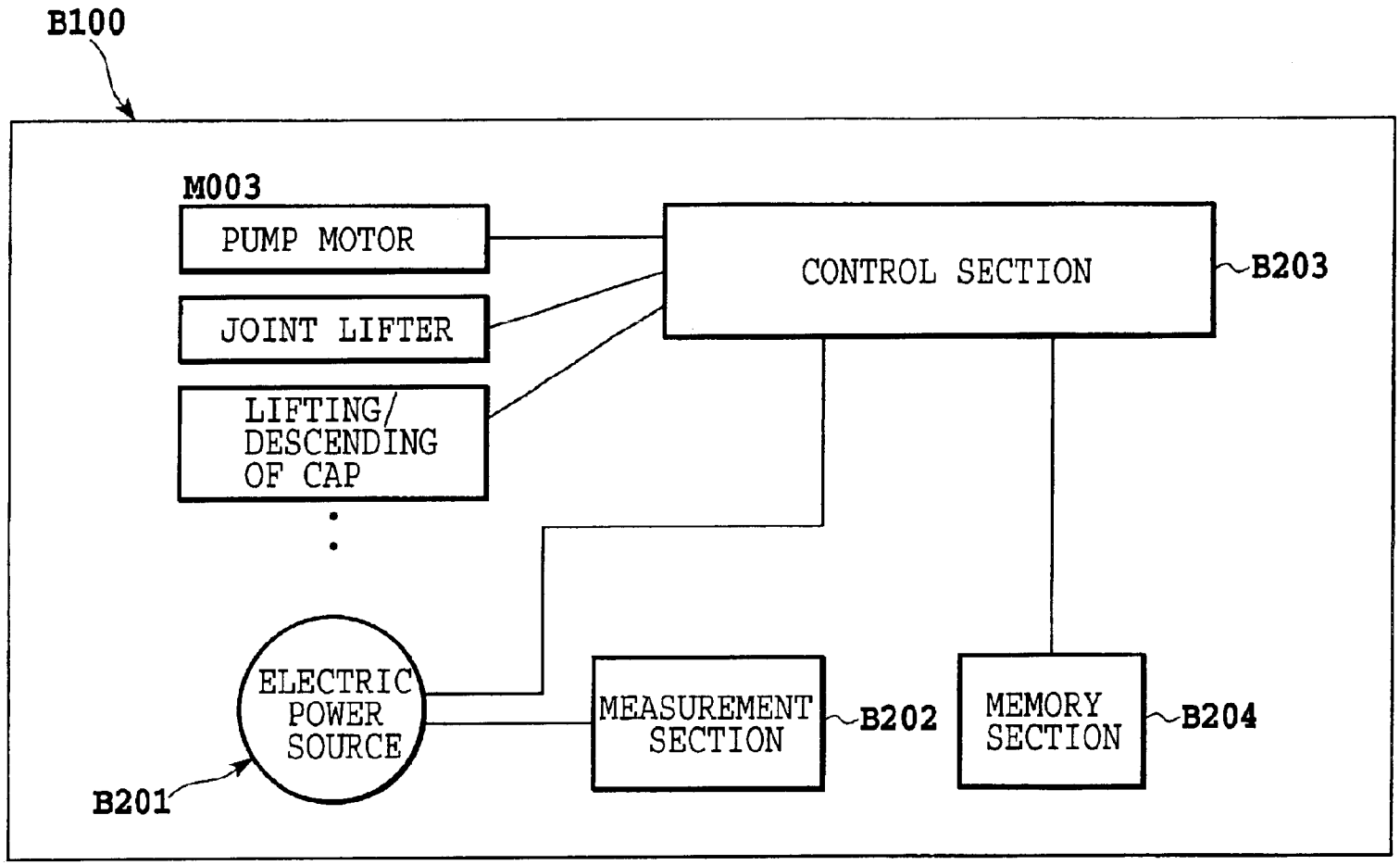
FIG. 8 is a block diagram for controlling a timing of discharging ink.

FIG. 8 illustrates a structure of a recording apparatus for realizing such a control.

In FIG. 8, B201 denotes an electric power source built-in in the recording apparatus B100. This power source B201 is not a dry battery of size AA described before but a button-shaped built-in type battery. B202 denotes a measurement section for measuring a time period for which the power source in a body of the recording apparatus is switched OFF. B203 denotes a control section and B204 denotes a memory section. The control section B203 causes the electric power source of the body to be automatically switched ON at an instant when the measurement result of the measurement section exceeds a value stored in advance in the memory section B204, whereby the ink supply recovery system is operated. Concretely, the above-mentioned ink discharging operation is carried out by driving the pump motor M003, lifting/descending the joint lifter and lifting/descending the suction cap B310. A period for prosecution of ink discharging; i.e., a value to be stored in the memory section may be determined in accordance with ink components and/or situations of the environment in which the apparatus is used. Since an evaporation amount is generally small when being left for 2 or 3 days, there is no significant problem even if ink is filled without discharging. Accordingly, while an allowable period is approximately 5 days in this embodiment, this value may be variable, of course.

According to this structure, when the recording operation is carried out again after a relatively short non-used period, fresh ink is added to the residual ink of the preceding recording operation which has hardly be condensed. Thus, the use efficiency of ink is improved and an amount of waste ink is reduced. Also, since the ink discharging sequence is not operated in every recording operation, there is an effect in that a time necessary for the post-treatment carried out after the recording operation becomes short.

Further, ink may be discharged after the power of the recording apparatus is switched OFF. In this case, since the discharge of ink is not carried out after the usual recording operation has finished, the same effect as in the case explained with reference to FIG. 8 is obtainable. Also, such an elaborate structure is unnecessary as shown in FIG. 8.

As described hereinabove, according to the present embodiment in the on-demand supply system, by controlling the bulk volume of sponge filling in the sub-tank, it is possible to control the concentration of colorant in the sub-tank within a predetermined range and always output an image having a stable color tone.

(3) Other Embodiments

In the above-mentioned embodiment, the method was explained, for regulating the degree of compression of sponge filled in the sub-tank and reducing an amount of residual ink for the purpose of achieving R=1.15. Alternatively, no sponge is provided in the sub-tank, but an ink chamber is provided in which ink is directly stored. Also in this method, it is possible to reduce an amount of residual ink because a bulk volume of sponge becomes zero.

Instead of reducing an amount of residual ink, a ratio of residual ink may be reduced by somewhat enlarging a capacity of the sub-tank. Since the sponge is used as a negative pressure generating source for retaining ink in the sub-tank, the degree of compression exceeding a predetermined value is necessary. Thereby, there may be a case in which it is impossible to lower the degree of compression in half as described above. Even in such a case, it is possible to obtain the effect of the present invention by somewhat enlarging a capacity A of the sub-tank while maintaining an amount of residual ink as it is. Of course, the capacity of the sub-tank may be enlarged while regulating the degree of compression of sponge.

Irrespective of adopting either of the methods, the present invention is effective in the on-demand supply system repeating the recording, ink-discharging and ink-suction even if the colorant concentration of ink used reaches the saturated state, if the condensation percentage R of ink is suppressed within a predetermined range from the initial ink.

In this regard, the sub-tank as an ink storage container may be of an ink jet cartridge type integral with a recording head other than that formed separately from the recording head.

While the explanation is made on the printer built-in type camera in which the camera section A100 is integral with the recorder section B100 in the above embodiments, the present invention should not be limited thereto. The same function and effect are achievable even in a structure in which the camera section A100 and the recorder section B100 are separated from each other and connected via an interface.

While the recording apparatus connected to the camera was used in the above description, the present invention should not be limited thereto. The ink jet recording apparatus unconnected to the camera section may be effective. Also, the recording apparatus integral with or connect to an apparatus except for camera section (such as; game machine, personal computer etc.) may be effective. For example, the present invention is effective even in a case in which a recording apparatus is integral with the game machine and outputs a card from a game image. In this case, it is unnecessary to restrict the condensation percentage R within an allowable range at 1.15 but may be changed in accordance with uses and purposes. In this embodiment, ΔE is limited within 5 so that no change occurs in tint as much as possible to be suitable for a photographic image quality. However, the allowable range of R may be widened to 1.20 or the like in accordance with the requirements of the user or the costs of the recording apparatus. In this regard, preferably R is 1.2 or less and ΔE is less than 10 if possible.

In the above description, an ink jet recording head provided with electro-thermal converter for generating energy used for ejecting ink was used. However, the present invention should not be limited thereto. The present invention is effective when an ink jet recording head of a type having an electro-mechanical converter such as a piezoelectric element is used.

As described above, according to the present invention, since the ink condensation percentage is lower than 1.20 that is, ΔE dose not exceed 10 which is the upper limit of the image estimation even if the colorant concentration of ink in the sub-tank reaches the saturated state, there is less variation in color difference between recorded images even though the recording, ink-discharge and ink-suction are repeated, whereby an image of natural and stable color tone can be output.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus comprising a main-tank for storing ink, a sub-tank for directly supplying ink to a recording head for carrying out the printing operation to a recording medium by ejecting ink, ink supply means for suppling a predetermined amount of ink from said main-tank to said sub-tank, and ink discharge means for discharging ink in said sub-tank, wherein in the following equation:

$$A/(A-a\times B)=R\leqq 1.20$$

the maximum amount of ink capable of being stored in said sub-tank is represented by A, an amount of residual ink remaining in said sub-tank after the ink has been discharged by said ink discharge means is represented by "a", a ratio by weight of a volatile component in the ink used is represented by B, and a ratio of a colorant concentration of the ink at a saturated state by repeating the ink supply and the ink discharge to an initial colorant concentration of the ink is represented by R, and wherein the A, the "a" and the B are set so as to satisfy the above equation.

2. An ink jet recording apparatus as claimed in claim 1, wherein R is determined so that the difference in color difference ΔE between an image recorded with ink having the initial colorant concentration and an image recorded with ink in which the colorant concentration condensed to the saturated value is within 10 in a CIE1976 L*a*b*color space.

3. An ink jet recording apparatus as claimed in claim 1, wherein R is not greater than 1.15.

4. An ink jet recording apparatus as claimed in claim 1, wherein a porous material is provided in the interior of said sub-tank.

5. An ink jet recording apparatus as claimed in claim 1, wherein a porous material and a gap to be filled with ink are provided in the interior of said sub-tank.

6. An ink storage container for storing a predetermined amount of ink so that the ink is directly supplied to a recording head for carrying out the recording operation on a recording medium by the ejection of ink; the stored ink being discharged therefrom when the recording operation is not carried out;

wherein in the following equation:

$$A/(A-a\times B)=R\leqq 1.20$$

the maximum amount of ink capable of being stored therein is represented by A, an amount of residual ink remaining therein after the stored ink has been discharged is represented by "a", a ratio by weight of a volatile component in a composition of ink used is represented by B, and a ratio of a colorant concentration of ink at a saturated state made by repeating ink supply and ink discharge to an initial colorant concentration of said ink is represented by R, and wherein said ink storage container is formed to have the amount "a" of residual ink and the maximum amount A of ink satisfying the above equation.

7. An ink cartridge comprising an ink storage container as claimed in claim 6 and an ink jet head supplied with ink from said container, for carrying out the recording operation by ejecting ink supplied from said container.

* * * * *

UNITED STATES PATENT AND TRADEMARK OFFICE

CERTIFICATE OF CORRECTION

PATENT NO. : 6,929,341 B2
DATED : August 16, 2005
INVENTOR(S) : Yoshito Mizoguchi et al.

It is certified that error appears in the above-identified patent and that said Letters Patent is hereby corrected as shown below:

Column 3,
Line 5, “an image” should read -- of an image --.

Column 5,
Line 19, “an” should read -- of an --.

Column 15,
Line 29, “connect” should read -- connected --; and
Line 53, “dose” should read -- does --.

Column 16,
Line 6, “suppling” should read -- supplying --.

Signed and Sealed this

Seventh Day of February, 2006

JON W. DUDAS
*Director of the United States Patent and Trademark Office*